United States Patent [19]

Yamazaki et al.

[11] Patent Number: 4,520,090

[45] Date of Patent: May 28, 1985

[54] MAGNETIC TONER

[75] Inventors: Hiroshi Yamazaki; Kiyoshi Tamaki, both of Hino, Japan

[73] Assignee: Konishiroku Photo Industry Co., Ltd., Tokyo, Japan

[21] Appl. No.: 499,185

[22] Filed: May 31, 1983

[30] Foreign Application Priority Data

Jun. 2, 1982 [JP] Japan ..... 57-93056

[51] Int. Cl.[3] ..... G03G 9/14

[52] U.S. Cl. ..... 430/106.6; 430/111; 430/138

[58] Field of Search ..... 430/107, 109, 137, 106.6, 430/111, 138

[56] References Cited

U.S. PATENT DOCUMENTS 4,212,966 7/1980 McClain ..... 525/62

4,265,992 5/1981 Kouchi et al. ..... 430/106.6

4,265,995 5/1981 Mammino ..... 430/106.6

*Primary Examiner*—John E. Kittle

*Assistant Examiner*—John L. Goodrow

*Attorney, Agent, or Firm*—Frishauf, Holtz, Goodman & Woodward

[57] ABSTRACT

There is disclosed a magnetic toner comprising a magnetic powder and a compound having the following general formula:

General formula I wherein $R_1$, $R_2$, $R_3$, A and M are the same as defined in the specification.

The magnetic toner of the present invention has a high degree of blackening and permits the stable formation of a sharp image.

19 Claims, 1 Drawing Figure

MAGNETIC TONER

Figure 1:
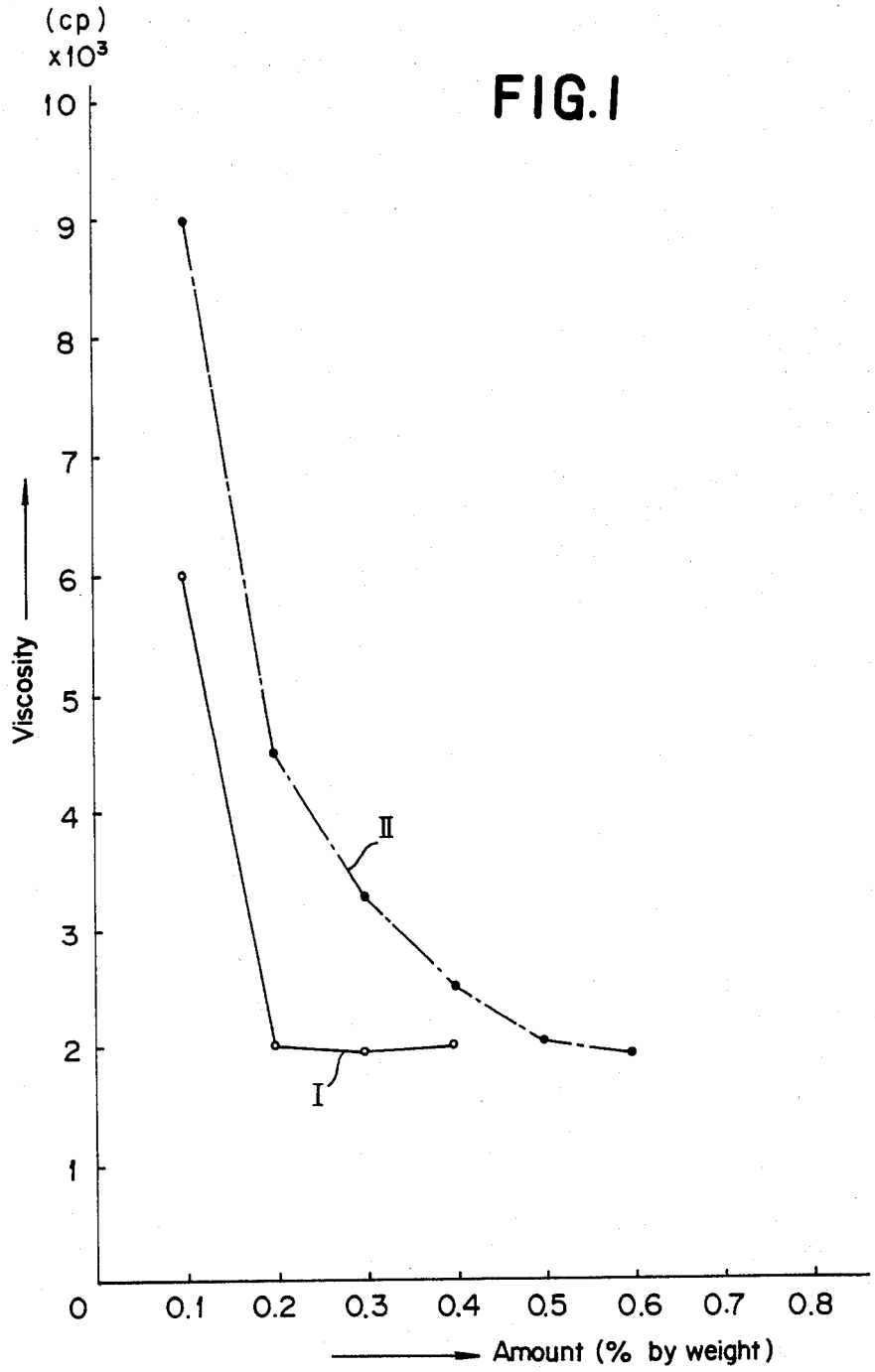

This invention relates to a magnetic toner for use in electrophotography, electrostatic recording and magnetic recording processes.

In a field regarding the technique of image formation, there are heretofore known various photographies, recording systems and printing systems which include the steps of forming an electrical latent image (electrostatic latent image) and visualizing the formed latent image with the aid of a coloring fine particle powder called a toner. With regard to the electrophotography, many techniques are suggested, for example, in U.S. Pat. No. 2,297,691, Japanese Patent Publication Nos. 23910/1967, 24748/1968 and elsewhere. Generally speaking, electrophotography comprises the steps of forming an electrical latent image on a light-sensitive sheet, in which a photoconductive material is used, by an optical means; developing the formed latent image by the use of a toner; if desired, transferring the resultant powder image comprising the toner to a transfer material such as a paper; and fixing the image with heat, pressure or vaporized solvent to obtain a copy. As methods for visualizing the electrical latent image, i.e. electrostatic latent image by the use of the toner, there are known, for example, a magnetic brush development in U.S. Pat. No. 2,874,063, a cascade development in U.S. Pat. No. 2,618,552 and a powder cloud method in U.S. Pat. No. 2,221,776. Developing agents for use in these developments can be roughly classified into an one-component series which comprises only a coloring fine powder, generally called a toner, capable of being attracted or repelled selectively by static charges, and the so-called two-component series in which a carrier such as an iron powder or glass beads is mixed with the aforementioned one-component series agent. In the case of the former developing agent, the latent image can be developed by electric charges induced from a magnetic metal sleeve conductor for carrying the developing agent or by charged bodies generated by friction with the sleeve; and in the case of the latter developing agent, the latent image can be developed by charged bodies generated by friction with the carrier. As the developing method in which the one-component series developing agent comprising only the toner is employed, the so-called induction development (which is described, e.g. in Japanese Patent Publication No. 491/1962) is especially well known.

In short, according to this method, a toner having conductive and magnetic properties is affixed to a sleeve equipped with a magnet therein in order to form a magnetic brush of the toner, and this magnetic brush is brought into contact with an electrostatic latent image carrier, so that the latent image is developed with the toner. In the case of the above developing method, when the magnetic brush is confronted with the electrostatic latent image, charges having a polarity opposite to that of the electrostatic latent image are induced in the conductive toner and the latent image is developed on the basis of electrical magnetism between the charge-induced toner and the electrostatic latent image. Further, another developing method is known in which an insulating magnetic toner is affixed to a sleeve equipped with a magnet therein in order to form a magnetic brush of the toner, the toner is charged by friction with the sleeve, and a latent image is developed by the toner by bringing the magnetic brush into contact with or near an electrostatic latent image carrier. For example, the developing method in which a capsule magnetic toner is utilized is described in Japanese Provisional Patent Publication No. 17739/1974, and the other method in which an insulating magnetic toner is employed is disclosed in Japanese Provisional Patent Publication No. 45639/1975.

With regard to these developing methods of using the one-component series developing agents, since the developing agent includes no carrier, it is needless to regulate a mixing ratio of the carrier and the toner, and a stirring operation to uniformly mix the carrier with the toner is not required particularly. Therefore, a whole developing device for this method has an advantage that it can be conveniently constructed in a simple and compact constitution.

Further, a disadvantage such as deterioration in quality of a developed image, which results from degradation of the carrier with time, cannot be brought about.

The aforementioned magnetic toner can be prepared by dispersing a predetermined amount of magnetic fine particles in a toner binder, but the magnetic fine particles are generally bad in dispersibilities in the toner binder. Therefore, it is difficult to manufacture the uniform magnetic toner without scatter. Further, when the kneaded magnetic toner is ground, wetting between surfaces of the magnetic particles and the binder resin is poor. Accordingly, separation tends to occur therebetween, and the magnetic fine particles are liable to appear on the surface of the toner particles, so that electric resistance of the toner drops. Moreover, humidity resistance of the toner is poor, and its dispersibilities are also bad, with the result that a blackening degree of the toner is low.

In order to improve dispersibilities of the magnetic powder in the binder comprising a resin or the like, a method is proposed in which the magnetic powder is treated with the so-called coupling agent having a function to enhance compatibility between an inorganic material and an organic material, whereby affinity of the magnetic powder to the binder is heightened. For example, Japanese Provisional Patent Publication Nos. 127329/1979 and 26519/1980 disclose a silane coupling agent and a titanium series coupling agent, respectively. Further, Japanese Provisional Patent Publication No. 76233/1979 discloses a micro-capsule toner in which dispersibilities are improved with the aid of lecithin. Although excellent in enhancement of the affinity between the inorganic agent and organic materials, the silane coupling agent and the titanium coupling agent both are apt to be hydrolyzed, and accordingly processing effects tend to reduce. In addition, the lecithin is weaker in functional effects than that of the coupling agents, and is thus required to be used a great deal, which fact leads to a fear that characteristics of the toner are sacrificed.

Accordingly, an object of this invention is to provide a magnetic toner which is high in image denseness and can always form a stable and clear image, without such drawback as mentioned above. Another object of this invention is to provide a magnetic toner excellent in humidity resistance.

These objects above can be accomplished by providing a magnetic toner containing a binder, a magnetic powder and a compound having the following general formula I:

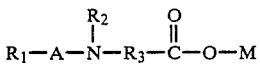

General formula I wherein $R_1$ represents an alkyl group or an alkenyl group each having 4 to 30 carbon atoms; $R_2$ represents a hydrogen atom or a methyl group; $R_3$ represents an alkylene group having 1 to 4 carbon atoms; A represents a carbonyl group or a sulfonyl group; and M represents a hydrogen atom, an alkali metal, an alkali earth metal or an amine.

FIG. 1 is a diagram showing experimental results with regard to a magnetic toner according to this invention.

The compound represented by general formula I above includes the carbonyl group and the amido group or the sulfamido group having affinity to the magnetic substance and possesses a hydrophobic group $R_1$ at one end portion of the molecule. Therefore, the groups having affinity to the magnetic substance are combined with this material on the surface thereof, with the hydrophobic groups oriented outward, whereby the affinity of the magnetic substance to an organic material is finally improved all over to an enough extent, in other words the compatibility of the magnetic substance with the binder comprising a resin or the like increases. As a result, there can be obtained a toner in which the magnetic powder is uniformly dispersed and which has great humidity resistance, and according to this toner, scatter caused in manufacture can be inhibited and a great blackening degree can be obtained. Moreover, an insulating magnetic toner or micro-capsule type magnetic toner can be produced which is excellent in chargeability and transferability and which can always form stable, clear and high-dense images.

Concrete examples of compounds represented by the aforesaid general formula I include the following:

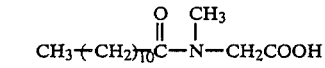

(1)

Sarcosinate LH (Nikko Chemicals Co., Ltd.)

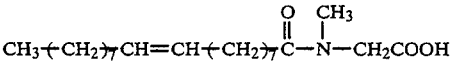

(2)

Sarcosinate OH (Nikko Chemicals Co., Ltd.)

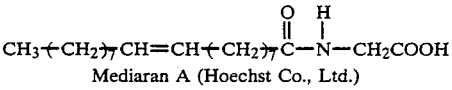

(3)

Mediaran A (Hoechst Co., Ltd.)

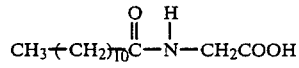

(4)

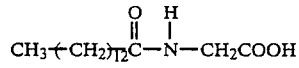

(5)

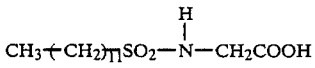

(6)

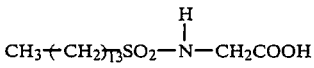

(7)

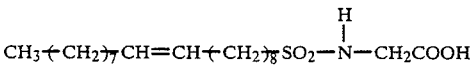

(8)

-continued

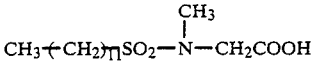

(9)

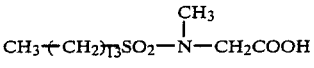

(10)

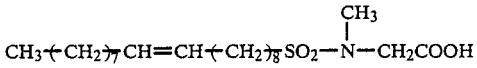

(11)

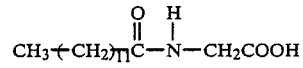

(12)

(13)

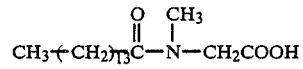

(14)

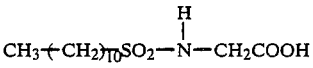

(15)

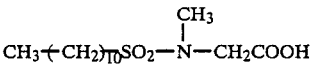

(16)

Salts of the above enumerated compounds (1) to (16). (17)

With regard to the salts mentioned above, examples of metallic salts includes salts of sodium, lithium, calcium, zinc and lead; salts of aliphathic amines or olefin amines each having a long carbon chain include, for example, salts of linoleyl amine, oleyl amine, lauryl amine and cacao butter amine; salts of heterocyclic amines include, for example, salts of morpholine; salts of amines each having several amine groups per molecule include, for example, salts of diethylenetriamine and triethylenetetramine; salts of aromatic amines include, for example, salts of alkyl-substituted anilines; and salts of tertiary amines include, for example, salts of trialkanolamine such as triethanolamine, trialkylamine such as triethylamine. In addition, the above-mentioned salts may include salts of other amines and the like.

The compound represented by general formula I is preferably employed in an amount of 0.01 to 2% by weight with respect to the magnetic powder. In the case of the amount being below 0.01% by weight, the desired effects cannot be obtained; in the case of the amount being above 2% by weight, a system is supersaturated with the compound, but functional effects of the compound cannot be increased. In principle, the amount of the compound to be added is such that the surfaces of the magnetic powder particles are coated with the compound in the form of a monomolecular layer.

As the magnetic powder, any magnetic substance which is employed in the conventional magnetic toner is usable, and examples of the magnetic substances include metals such as iron, nickel and cobalt; and alloys as well as oxides of iron, nickel, cobalt, manganese, copper and aluminum such as various ferrites and magnetites. A diameter of the magnetic fine particles used in this invention ranges from about 0.1 to 5μ, preferably from 0.1 to 1μ. Concrete examples of the magnetic materials include "RB-BL", "BL-100", "BL-500", "BL-SP", "BL-200" and "BL-250" which are manufactured by Titan Kogyo Co., Ltd. as well as "EPT-500", "EPT- 1000", "MRM-B-450" and "MTC-720" which are manufactured by Toda Kogyo Co., Ltd. An amount of the magnetic powder to be used is such that it is contained in the toner in a proportion of 30 to 70% by weight, preferably 40 to 65% by weight.

For treatment of the magnetic powder with the compound above, there can be utilized, for example, a method in which the compound is dissolved in a solvent such as toluene, and a suitable amount of the magnetic powder is added thereto and mixed therewith, followed by enough stirring and distillation for the removal of the solvent; or a method of adsorbing the compound on the surfaces of the magnetic substances in a spray drying manner. Alternatively, a predetermined amount of the compound may be added to a resin during a kneading step so as to be kneaded with the resin.

Further, in order to prepare a micro-capsule type toner, a liquid material is used as a core material, a predetermined amount of the aforementioned compound is added to the core material and is dissolved therein, and the magnetic powder is further added thereto and dispersed therein.

As the binder, any resin whcih can be heretofore employed in this art is usable. For example, such resins include a variety of conventional and known thermoplastic resins which are suitable for a heat fixing system such as a heat roll fixing system or a flash fixing system.

Concrete examples of such thermoplastic resins include polymers from monomers of styrenes such as styrene, p-chlorostyrene and α-methylstyrene; esters of α-methylene aliphatic monocarboxylic acids such as methyl acrylate, ethyl acrylate, n-propyl acrylate, lauryl acrylate, 2-ethylhexyl acrylate, methyl methacrylate, ethyl methacrylate, n-butyl methacrylate, lauryl methacrylate and 2-ethylhexyl methacrylate; vinylnitriles such as acrylonitrile and methacrylonitrile; vinylpyridines such as 2-vinylpyridine and 4-vinylpylidine; vinylethers such as vinyl methylether and vinyl isobutyl ether; vinylketones such as vinyl methyl ketone, vinyl ethyl ketone and methyl isopropyl ketone; unsaturated hydrocarbons such as ethylene, propylene, isoprene and butadiene, halides of the above-mentioned unsaturated hydrocarbons, and halogenated unsaturated hydrocarbons such as chloroprene; non-vinyl condensation resins such as rosin modified phenol-formaldehyde resin, oil modified epoxy resin, polyester resin, polyurethane resin, polyimide resin, cellulose resin and polyether resin; and mixtures of the above-mentioned non-vinyl condensation resins and vinyl resins.

In the case of preparation of the toner which is used as a toner for pressure fixation, any binder which is heretofore known as the binder usable in the toner for pressure fixation can be utilized in this invention. Concrete examples of such binders include polyolefins such as polyethylene, polypropylene and polytetrafluoroethylene; polyethylene copolymers such as ethylene-vinyl acetate copolymer, ethylene-acrylate copolymer and ethylene-methacrylate copolymer; polyesters; styrenebutadiene copolymer; waxes such as beeswax, carnauba wax and microcrystalline wax; higher fatty acids such as stearic acid and palmitic acid; salts and esters of these higher fatty acids; epoxy resins; rubbers such as isobutylene rubber, cyclized rubber and nitrile rubber; polyamides; coumarone-indene resins; maleic acid modified phenol resins; phenol modified terpene resins; and silicone resins.

In the case of preparation of the micro-capsule type toner, the magnetic toner according to this invention can be applied to any conventional and known micro-capsule type toner. As core materials for the micro-capsule type toner, there are, in addition to ones recited previously as the examples of the binders used in the toner for the pressure fixation, liquid polybutene, liquid polychloroprene, liquid polybutadiene, epoxidized soybean oil, epoxidized triglyceride, epoxidized monoester, adipic acid polyester, liquid polyester, chlorinated paraffins, esters of trimellitic acid, vegetable oils such as soybean oil, perilla oil and tung oil, synthetic drying oil, silicone oil, mineral oil, polymethyl acrylate, polyethyl acrylate, polybutyl acrylate, polybutyl methacrylate, polylauryl methacrylate, oligomers of acrylic and methacrylic esters, oligomers of styrene monomer, oligomers of copolymers of styrene and acrylic esters, oligomers of copolymers of styrene and methacrylic esters, polyvinyl acetate, and petroleum residues such as asphalt and gilsonite.

As wall materials, the thermoplastic resins as mentioned above can be used, and there can also be employed resins each in which vinyl monomers capable of forming a thermoplastic resin are cross-linked. Usable cross-linking agents each have 2 or more radical cross-linking groups, and examples of the cross-linking agents include aromatic divinyl compounds such as divinylbenzene and divinylnaphthalene; bifunctional acrylates and methacrylates such as ethylene glycol dimethacrylate, diethylene glycol dimethacrylate, neopentyl glycol dimethacrylate, propylene glycol dimethacrylate, ethylene glycol diacrylate and propylene glycol diacrylate; trifunctional acrylates and methacrylates such as trimethylolpropanetriacrylate and trimethylolpropanetrimethacrylate; and divinyl ethers. Additionally, examples of the wall materials used suitably in this invention include polyamides produced by reactions of polyvalent carboxylic acid chlorides such as terephthaloyl chloride, adipic acid chloride and sebacic acid chloride with polyvalent amines such as ethylenediamine, triethylenetetramine, imino-bis-propylamine, phenylenediamine and xylylenediamine; polyurethane resins produced by reactions of polyisocyanates such as reaction products of toluyleneisocyanate with trimethylolpropane, hexamethylenediisocyanate, methaphenylenediisocyanate, 3,3'-dimethyldiphenyl-4,4'-diisocyanate, triphenylmethanetriisocyanate, naphthalenediisocyanate with polyvalent alcohols such as ethylene glycol, propylene glycol, butylene glycol, hexamethylene glycol, glycerin and trimethylolpropane in the presence of water; and polyurea resins produced by reactions of the aforesaid polyisocyanates and polyamines.

The magnetic toner of the present invention may contain a colorant. Examples of such colorants include carbon black, Nigrosine dye (C.I. No. 50415 B), Aniline Blue (C.I. No. 50405), Chalco Oil Blue (C.I. No. Azoyc Blue 3), Chrome Yellow (C.I. No. 14090), Ultramarine Blue (C.I. No. 77103), Du-Pont Oil Red (C.I. No. 26105), Quinoline Yellow (C.I. No. 47005), Methylene Blue Chloride (C.I. No. 52015), Phthalocyanine Blue (C.I. No. 74160), Malachite Green Oxalate (C.I. No. 42000), Lamp Black (C.I. No. 77266), Rose Bengar (C.I. No. 45435), mixtures thereof and others. The colorant may be included typically in an amount of 0.5 to 10% by weight of the whole toner.

Further, a charge regulator may be contained in the magnetic toner according to this invention, and any charge regulator may be employed therein.

As be definite from the foregoing, the toner according to this invention may be formed to any type. For example, the toner including the binder resin may be prepared in accordance with a method having a melting and kneading process as well as a grinding process, and the microcapsule type toner may be prepared in accordance with a variety of methods such as a coacervation, a spray drying process, an in-situ polymerization, fluidized bed process and a submerged drying process.

This invention will be described hereinafter in accordance with practical examples, but no restriction on this invention is intended thereby at all.

EXPERIMENTAL EXAMPLE 1

To 100 g of soybean oil was added 100 g of a magnetic powder "BL-100" (which is available from Titan Kogyo Co., Ltd.; oil absorption amount: 27 ml/100 g), so that a mixture having no fluidity was obtained. The compound "Sarcosinate LH" (which is available from Nikko Chemicals Co., Ltd.) having formula (1) mentioned previously was added to the obtained mixture, and viscosity variation of the mixture versus amount of the compound was measured by the use of a B-type rotary viscometer at a temperature of 25° C. at a speed of 60 rpm. The results are set forth with curve I in FIG. 1.

Further, in place of "Sarcosinate LH", lecithin was added thereto and viscosity variation in this case was also measured in a similar way. The results are set forth with curve II in FIG. 1.

As be apparent from FIG. 1, when 0.2% by weight or so of "Sarcosinate LH" is added to the magnetic powder, enough fluidity can be obtained by the addition of it alone.

EXPERIMENTAL EXAMPLE 2

The same procedure as in Experimental example 1 was carried out with the exception that "Sarcosinate LH" was replaced with the compound "Sarcosinate OH" having formula (2) mentioned above. Satisfactory effects were similarly obtained by adding 0.2% by weight of the compound to the magnetic powder.

EXAMPLE 1

Melted and kneaded were 500 g of styrene-butyl acrylate copolymer in which the styrene component and the butyl acrylate component were contained in a ratio of 85:15 by weight, 500 g of the magnetic powder "BL-100", and 1 g of "Sarcosinate OH". Then, cooling and grinding followed to prepare a magnetic toner of this invention. The prepared toner was named Sample 1.

EXAMPLE 2

The same procedure as in Example 1 was repeated with the exception that the styrene-butyl acrylate copolymer was replaced with ethylene-vinyl acetate copolymer in which the ethylene component and vinyl acetate component were contained in a ratio of 60:40 by weight, and a magnetic toner of this invention was prepared. This toner was named Sample 2.

EXAMPLE 3

The same procedure as in Example 1 was repeated with the exception that "Sarcosinate OH" was replaced with "Sarcosinate LH", in order to prepare a magnetic toner of this invention. This toner was named Sample 3.

EXAMPLE 4

The same procedure as in Example 2 was repeated with the exception that "Sarcosinate OH" was replaced with "Sarcosinate LH", in order to prepare a magnetic toner of this invention. This toner was named Sample 4.

EXAMPLE 5

Mixed were 425 g of styrene, 75 g of butyl acrylate, and 1 g of "Sarcosinate LH" to obtain a uniform solution, and 500 g of the magnetic powder "BL-100" was added to the thus obtained solution, followed by enough stirring in order to prepare an uniform mixture. To this mixture was further added 4 g of a polymerization initiator azobisisobutyronitrile, and they were uniformly mixed to prepare a polymerizable composition. The prepared polymerizable composition was added to 1.5 l of water in which 30 g of tricalcium phosphate and 0.3 g of dodecylbenzenesulfonic acid were dispersed, and was dispersed therein by the use of a homojetter so that the polymerizable composition might be divided into droplets each having as great an average diameter as 10 to 20$\mu$. The temperature of a system was maintained at 60° to 70° C. for a period of 7 to 8 hours while moderately stirring, in order to allow polymerization. Afterward, treatment was carried out with hydrochloric acid, and washing with water as well as drying followed to prepare a magnetic toner of this invention. The thus prepared magnetic toner was named Sample 5.

EXAMPLE 6

| | |
|---|---|
| Styrene | 50 g |
| Neopentylglycoldimethacrylate | 100 g |
| Soybean oil | 150 g |
| Ceresine | 10 g |
| Magnetic powder "BL-100" | 300 g |
| "Sarcosinate OH" | 0.9 g |

These materials were uniformly mixed and stirred at a temperature of 60° to 70° C. in order to prepare a monomer mixture. To the resultant monomer mixture was added 7.5 g of lauroyl peroxide as a polymerization initiator and it was dissolved therein. The mixture was then dispersed in 3000 ml of water in which 20 g of colloidal calcium phosphate and 0.2 g of sodium dodecylbenzenesulfonate were dispersed, while stirring at a speed of 5000 rpm by the use of a stirrer homojetter so that an average diameter of the dispersed particles might be 10 to 15$\mu$ on the basis of observation by an optical microscope. The resultant dispersion was placed in a four-necked flask, and polymerization reaction was allowed in the system at an elevated temperature of 75° C. for a period of 10 hours while stirring at a speed of 300 rpm. After completion of the reaction, hydrochloric acid was added thereto in order to decompose and remove a dispersion stabilizer, and filtration, washing and drying were carried out to prepare a toner of this invention which had an average particle diameter of 12$\mu$. The prepared toner was named Sample 6.

Example 7

| | |
|---|---|
| Polybutene "LV-10" | 100 g |
| Ceresine | 21 g |
| Magnetic powder "BL-100" | 150 g |
| "Sarcosinate OH" | 0.9 g |

These materials were mixed and stirred at a temperature of 70° C. Then, a solution prepared by dissolving 35 g of terephthaloyl chloride in 50 g of dibutyl phthalate at a temperature of 60° C. was added to the resultant mixture in order to prepare a magnetic ink. The thus obtained ink was dispersed in 1000 ml of an aqueous solution in which 3.3% by weight of polyvinyl alcohol was dissolved, by the use of a homojetter while stirring at a speed of 6000 rpm so that an average diameter of the dispersed particles might be 10 to 15μ on the basis of observation by an optical microscope. The resultant dispersion was placed in a four-necked flask, and 80 ml of an aqueous solution in which 15 g of diethylenetriamine and 10 g of sodium carbonate were dissolved was gradually added stirring to the dispersion. The mixture in the flask was stirred in-situ at room temperature for a period of 6 hours, followed by filtration and washing to form a capsule slurry. The resultant slurry was treated with a reactive melamine condensate, and was subjected to spray drying in order to prepare a capsule type magnetic toner of this invention. The prepared magnetic toner was named Sample 7.

EXAMPLE 8

| | |
|---|---|
| Dibutyl phthalate | 80 g |
| Magnetic powder "BL-100" | 100 g |
| "Sarcosinate OH" | 0.3 g |

These materials were mixed and stirred to prepare a fluid mixture, and 20 g of polyisocyanate Desmodule L-75 (which is manufactured by Sumitomo Bayer Urethane Co., Ltd.) was uniformly added thereto in order to prepare a magnetic ink. This magnetic ink was added to 800 ml of water including 10 g of a colloidal silica while stirring at 8000 rpm by the use of a homojetter, and regulation was made so that an average diameter of the produced particles might be within the range of 10 to 15μ on the basis of observation by an optical microscope. The resultant dispersion was placed in a four-necked flask, and 100 ml of an aqueous solution in which 5 g of ethylenediamine was dissolved was added dropwise thereto. Then, reaction of the solution was allowed at room temperature for a period of 5 hours while stirring at a speed of 300 rpm. After completion of the reaction, filtration, washing and drying were carried out in order to prepare a magnetic toner of this invention. The prepared toner was named Sample 8.

EXAMPLE 9

Following the method of Example 1 except that the compound having the aforementioned formula (9) was substituted for "Sarcosinate OH", a magnetic toner of this invention was prepared. This magnetic toner was named Sample 9.

EXAMPLE 10

Following the method of Example 1 except that the compound having the aforementioned formula (11) was substituted for "Sarcosinate OH", a magnetic toner of this invention was prepared. This was Sample 10.

EXAMPLE 11

Following the method of Example 2 except that the compound having the aforementioned formula (9) was substituted for "Sarcosinate OH", a magnetic toner of this invention was prepared. This was Sample 11.

EXAMPLE 12

Following the method of Example 2 except that the compound having the aforementioned formula (11) was substituted for "Sarcosinate OH", a magnetic toner of this invention was prepared. This was Sample 12.

COMPARATIVE EXAMPLE 1

Following the method of Example 1 except that "Sarcosinate OH" was eliminated, a magnetic toner for comparison was prepared. This was Comparative Sample 1.

COMPARATIVE EXAMPLE 2

Following the method of Example 2 except that "Sarcosinate OH" was eliminated, a magnetic toner for comparison was prepared. This was Comparative sample 2.

COMPARATIVE EXAMPLE 3

It was attempted to prepare a magnetic toner, following the method of Example 5 except that "Sarcosinate LH" was eliminated, but a formed polymer composition could not become liquid. Therefore, the composition could not be dispersed in a dispersion medium comprising water.

EXPERIMENTAL EXAMPLE 3

By the use of the samples and comparative samples obtained in the each of above examples and comparative examples, already formed electrostatic latent images were developed in an electrophotographic copying machine "U-Bix T" (which is manufactured by Konishiroku Photo Industry Co., Ltd.). Then, Samples 1, 3, 5, 9 and 10 as well as Comparative sample 1 were fixed for their powder images in accordance with a heat roll fixing system; and Samples 2, 4, 6, 7, 8, 11 and 12 as well as Comparative sample 2 were fixed for their powder images in accordance with a pressure fixing system, in order to form copy images.

Thus obtained respective copy image was tested for a maximum image density $D_{MAX}$. The results are set forth in the following table.

TABLE

| Sample | $D_{MAX}$ | Sample | $D_{MAX}$ |
|---|---|---|---|
| Sample 1 | 1.4 | Sample 2 | 1.4 |
| Sample 3 | 1.3 | Sample 4 | 1.4 |
| Sample 5 | 1.4 | Sample 6 | 1.35 |
| Sample 9 | 1.4 | Sample 7 | 1.4 |
| Sample 10 | 1.4 | Sample 8 | 1.3 |
| Comparative Sample 1 | 1.1 | Sample 11 | 1.4 |
| | | Sample 12 | 1.4 |
| | | Comparative Sample 2 | 1.1 |

As be apparent from this table, the magnetic toner according to this invention has a high blackening degree, therefore it can be understood that in the toner according to this invention, the magnetic powder can be satisfactorily uniformly dispersed in the binder, which permits a stable formation of a sharp image.

What is claimed is:

1. A magnetic toner which comprises a magnetic toner powder, a binder and a compound having the formula:

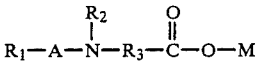

General formula I wherein $R_1$ represents an alkyl group or an alkenyl group each having 4 to 30 carbon atoms; $R_2$ represents a hydrogen atom or a methyl group; $R_3$ represents an alkylene group having 1 to 4 carbon atoms; A represents a carbonyl group or a sulfonyl group; and M represents a hydrogen atom, an alkali metal, an alkali earth metal or an amine.

2. The magnetic toner according to claim 1, wherein the amount of said compound is within the range of 0.01 to 2% by weight based on the weight of said magnetic toner powder.

3. The magnetic toner according to claim 1, wherein said magnetic toner powder is composed of powder particles selected from the group consisting of iron, nickel, cobalt, manganese, copper and alloys of the same; and oxides of iron, nickel, cobalt, manganese, copper and aluminum.

4. The magnetic toner according to claim 1, wherein said magnetic toner powder is composed of particles having a diameter of from 0.1 to 5$\mu$.

5. The magnetic toner according to claim 1, wherein said magnetic toner powder is present in an amount of 30 to 70% by weight based on the weight of said magnetic toner.

6. The magnetic toner according to claim 1, wherein said toner is used in a pressure fixation process.

7. The magnetic toner according to claim 1, wherein said binder is a thermoplastic resin selected from the group consisting of polymers obtained from monomers of styrenes, esters of $\alpha$-methylene aliphatic monocarboxylic acids, vinylnitriles, vinylpyridines, vinylethers, vinylketones, unsaturated hydrocarbons, halides of unsaturated hydrocarbons, halogenated unsaturated hydrocarbons, non-vinyl condensation resins, vinyl resins and mixtures thereof.

8. The magnetic toner according to claim 1, wherein said magnetic toner is a micro-capsule type toner.

9. The magnetic toner according to claim 1, wherein said magnetic toner further comprises a colorant.

10. The magnetic toner according to claim 9, wherein said colorant is present in an amount of 0.5 to 10% by weight based on the weight of said magnetic toner.

11. The magnetic toner according to claim 5, wherein said magnetic toner powder is present in an amount of 40 to 65% by weight based on the weight of said magnetic toner.

12. A magnetic toner which comprises a binder, a magnetic toner powder in an amount of 30 to 70% by weight based on the weight of said magnetic toner, said magnetic toner powder being composed of particles having a diameter of 0.1 to 5$\mu$, and 0.01 to 2% by weight based on the weight of said magnetic powder of a compound having the formula:

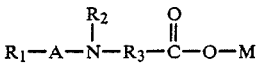

wherein $R_1$ represents an alkyl group or an alkenyl group each having 4 to 30 carbon atoms; $R_2$ represents a hydrogen atom or a methyl group; $R_3$ represents an alkylene group having 1 to 4 carbon atoms; A represents a carbonyl group or a sulfonyl group; and M represents a hydrogen atom, an alkali metal, an alkali earth metal or an amine.

13. The magnetic toner according to claim 12, wherein said magnetic toner powder is selected from the group consisting of iron, nickel, cobalt, manganese, copper and alloys of the same; and oxides of iron, nickel, cobalt, manganese, copper and aluminum.

14. The magnetic toner according to claim 12, wherein said toner is used in a pressure fixation process.

15. The magnetic toner according to claim 12, wherein said binder is a thermoplastic resin selected from the group consisting of polymers obtained from monomers of styrenes, esters of $\alpha$-methylene aliphatic monocarboxylic acids, vinylnitriles, vinylpyridines, vinylethers, vinylketones, unsaturated hydrocarbons, halides of unsaturated hydrocarbons, halogenated unsaturated hydrocarbons, non-vinyl condensation resins, vinyl resins and mixtures thereof.

16. The magnetic toner according to claim 12, wherein said magnetic toner is a micro-capsule type toner.

17. The magnetic toner according to claim 12, wherein said magnetic toner further comprises a colorant.

18. The magnetic toner according to claim 17, wherein said colorant is present in an amount of 0.5 to 10% by weight based on the weight of said magnetic toner.

19. The magnetic toner according to claim 12, wherein said magnetic toner powder is present in an amount of 40 to 65% by weight based on the weight of said magnetic toner.

* * * * *